US009840103B2

(12) United States Patent
Nagoshi

(10) Patent No.: US 9,840,103 B2
(45) Date of Patent: Dec. 12, 2017

(54) LIGHTWEIGHT COATED PRINTING PAPER FOR INDUSTRIAL INKJET PRINTING PRESS

(71) Applicant: MITSUBISHI PAPER MILLS LIMITED, Tokyo (JP)

(72) Inventor: Masanori Nagoshi, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 15/118,141

(22) PCT Filed: Jan. 22, 2015

(86) PCT No.: PCT/JP2015/051590

§ 371 (c)(1),
(2) Date: Aug. 11, 2016

(87) PCT Pub. No.: WO2015/122252

PCT Pub. Date: Aug. 20, 2015

(65) Prior Publication Data

US 2017/0173987 A1 Jun. 22, 2017

(30) Foreign Application Priority Data

Feb. 12, 2014 (JP) ..... 2014-024367

(51) Int. Cl.

| | |
|---|---|
| ***B41M 5/00*** | (2006.01) |
| ***B41M 5/52*** | (2006.01) |
| ***B41M 5/50*** | (2006.01) |
| ***D21H 19/38*** | (2006.01) |
| ***D21H 19/44*** | (2006.01) |
| ***D21H 19/84*** | (2006.01) |
| ***D21H 21/52*** | (2006.01) |

(52) U.S. Cl.

CPC ..... *B41M 5/5254* (2013.01); *B41M 5/502* (2013.01); *B41M 5/52* (2013.01); *B41M 5/5218* (2013.01); *B41M 5/5245* (2013.01); *D21H 19/385* (2013.01); *D21H 19/44* (2013.01); *D21H 19/84* (2013.01); *D21H 21/52* (2013.01); *B41M 5/5236* (2013.01); *B41M 5/5263* (2013.01)

(58) Field of Classification Search

CPC ..... B41M 5/508; B41M 5/52; B41M 5/5218; B41M 5/5254

See application file for complete search history.

(56) References Cited

U.S. PATENT DOCUMENTS

| | | | |
|---|---|---|---|
| 2012/0107531 | A1 | 5/2012 | Idei et al. |
| 2012/0114880 | A1 | 5/2012 | Nagoshi et al. |
| 2014/0363581 | A1 | 12/2014 | Nagoshi et al. |

FOREIGN PATENT DOCUMENTS

| | | | |
|---|---|---|---|
| JP | 2000-256992 | A | 9/2000 |
| JP | 2001-30619 | A | 2/2001 |
| JP | 2005-88525 | A | 4/2005 |
| JP | 2008-255551 | A | 10/2008 |
| JP | 2009-138317 | A | 6/2009 |
| JP | 2011-251231 | A | 12/2011 |
| JP | 2013-46985 | A | 3/2013 |
| JP | 2013-132854 | A | 7/2013 |
| WO | WO 2011/001955 | A1 | 1/2011 |
| WO | WO 2013/108753 | A1 | 7/2013 |

OTHER PUBLICATIONS

Miyagi, "Offset Quality Inkjet Printer", Japan Printer, Insatsu Gakkai Shuppanbu Ltd., Aug. 2010, vol. 93, pp. 25-29.

Tokumasu, "Inkjet Printer Compatible with B2 Wide Format Printing Paper", Japan Printer, Insatsu Gakkai Shuppanbu Ltd., Aug. 2010, vol. 93, pp. 21-24.

*Primary Examiner* — Betelhem Shewareged

(74) *Attorney, Agent, or Firm* — Birch, Stewart, Kolasch & Birch, LLP

(57) ABSTRACT

The present invention provides a lightweight coated printing paper for an industrial inkjet printing press, having a base paper, and one or more coating layers being disposed on at least one surface of the base paper and containing a pigment and a binder, wherein the total coating weight of the coating layer(s) is 6 g/m$^2$ or less per one surface, the at least one of the pigment in the coating layer(s) is ground calcium carbonate having an average particle diameter of 0.50 to 1.00 μm, wherein the amount of the ground calcium carbonate contained in the coating layer(s) is 50 parts by mass or more, relative to 100 parts by mass of the total of the pigment in the coating layer(s), the lightweight coated printing paper has an opacity of 92.0% or more, a Stöckigt sizing degree of 1.0 to 8.0 seconds, and a 10-second Cobb sizing degree of 30 to 80 g/m$^2$, wherein the ratio of the 10-second Cobb sizing degree to the Stöckigt sizing degree is 10.0 to 40.0.

2 Claims, No Drawings

LIGHTWEIGHT COATED PRINTING PAPER FOR INDUSTRIAL INKJET PRINTING PRESS

FIELD OF THE INVENTION

The present invention relates to a lightweight coated printing paper for an industrial inkjet printing press, which is used in an industrial inkjet printing press for commercial printing.

BACKGROUND ART

Inkjet recording method techniques have rapidly advanced, and industrial inkjet printing presses which employ an ink-jet recording method in an industrial or commercial printer for producing a number of commercial printed materials have been known {see, for example, Japanese Unexamined Patent Publication Nos. 2011-251231 and 2005-088525, "Ink-jet printing press applicable to B2-size printing paper", written by Michiko Tokumasu ("Japan Printer", published by Insatsu Gakkai Shuppanbu Ltd., August 2010 (Vol. 93), pages 21 to 24), and "Offset-quality inkjet printing press", written by Yasutoshi Miyagi ("Japan Printer", published by Insatsu Gakkai Shuppanbu Ltd., August 2010 (Vol. 93), pages 25 to 29)}. These industrial inkjet printing presses are marketed under the trade names, for example, TruepressJet of Dainippon Screen Mfg. Co., Ltd., MJP series of Miyakoshi Printing Machinery, Co., Ltd., Prosper and VERSAMARK of Eastman Kodak Company, and JetPress of FUJIFILM Corporation.

The industrial inkjet printing press exhibits a color printing speed which is ten to several tens times faster than an inkjet printer for general domestic use and for SOHO and a large format inkjet printer, and which, though, varies depending on various printing conditions, and the printing speed of the industrial inkjet printing press is 15 m/min or more, and the printing speed of that of a higher speed type is more than 60 m/min. For this reason, the industrial inkjet printing press is differentiated from an inkjet printer for general domestic use and for SOHO and a large format inkjet printer.

The industrial inkjet printing press can deal with variable information and therefore can be applied to on-demand printing. Printing companies frequently employ a form of printing method in which printing for fixed information is made by a conventional printing press, such as a gravure printing press, an offset printing press, a letterpress printing press, a flexographic press, a thermal transfer printing press, or a toner printing press, and printing for variable information is made by an industrial inkjet printing press. Particularly, in view of the printed image quality and production cost, an offset printing press is frequently used in printing for fixed information.

Therefore, the lightweight coated printing paper for an industrial inkjet printing press is required to have printability for both printing using a conventional printing press, such as an offset printing press, and printing using an industrial inkjet printing press. When the lightweight coated printing paper for an industrial inkjet printing press does not have printability for both the above printing presses, printed materials having satisfactory image quality as a commercial product cannot be produced using the above printing presses.

As inkjet recording paper having both excellent inkjet printability, for example, excellent ink absorbing property, color development property, or printing density, and excellent offset printability, there has been known an inkjet recording paper having, on at least one surface of a support, formed at least one pigment coating layer comprised mainly of a pigment and a binder, wherein needle-like and/or cylindrical precipitated calcium carbonate is contained as the pigment, wherein the precipitated calcium carbonate has a 50% by volume particle diameter (D50) of 0.2 to 0.7 μm in a particle size distribution curve as measured by a laser diffraction method, wherein the ratio (D90/D10) of the 90% by volume particle diameter (D90) to the 10% by volume particle diameter (D10) is 8 or less (see, for example, Japanese Unexamined Patent Publication No. 2013-132854). Further, as lightweight coated paper for offset printing, which can remarkably improve the printing opacity and has excellent color printing quality in multi-color offset printing, there has been known a lightweight coated paper for offset printing, having, on a base paper, a surface treatment agent layer comprised mainly of a pigment and a binder, wherein the base paper contains a filler having an oil absorption of 360 to 500 mL/100 g in an amount of 0.5 to 5.0% by mass, wherein the surface treatment agent layer contains calcium carbonate in an amount of 55 parts by mass or more, relative to 100 parts by mass of the total of the pigments, wherein the lightweight coated paper satisfies the following properties: a basis weight of 35 to 50 g/m$^2$, a coefficient of dynamic friction of 0.45 to 0.65, a brightness of 54% or more, a printing opacity of 90% or more, an oil absorption of 60 to 200 seconds, and a smoothness of 20 to 200 seconds (see, for example, Japanese Unexamined Patent Publication No. 2008-255551).

PRIOR ART REFERENCES

Patent Documents

Patent document 1: Japanese Unexamined Patent Publication No. 2011-251231

Patent document 2: Japanese Unexamined Patent Publication No. 2005-088525

Patent document 3: Japanese Unexamined Patent Publication No. 2013-132854

Patent document 4: Japanese Unexamined Patent Publication No. 2008-255551

Non-Patent Documents

Non-patent document 1: "Inkjet printing press applicable to B2-size printing paper", written by Michiko Tokumasu ("Japan Printer", published by Insatsu Gakkai Shuppanbu Ltd., August 2010 (Vol. 93), pages 21 to 24)

Non-patent document 2: "Offset-quality inkjet printing press", written by Yasutoshi Miyagi ("Japan Printer", published by Insatsu Gakkai Shuppanbu Ltd., August 2010 (Vol. 93), pages 25 to 29)

SUMMARY OF THE INVENTION

Problems to be Solved by the Invention

Ink for use in industrial inkjet printing presses is roughly classified into an aqueous dye based ink and an aqueous pigment based ink.

The aqueous dye based ink and aqueous pigment based ink respectively have different requirements for printing paper. With respect to the aqueous dye based ink, when the printing paper lacks in the ink absorbing property as the printing speed is increased, the boundary between colors in the printed portion is likely to blur. Therefore, printing paper having excellent ink absorbing property is desired. With respect to the aqueous pigment based ink, when the printing paper becomes partially uneven in the ink absorbing property as the printing speed is increased, the color density in the printed portion is likely to become non-uniform. The cause of this resides in that, due to the principle of ink jet that ink droplets are jetted from a very thin nozzle, an ink used in an industrial inkjet printing press has a low coloring material concentration, as compared to an ink used in a conventional printing press, such as an offset printing press. Therefore, printing paper having excellent uniformity of the color density is desired for the aqueous pigment based ink.

In the field of commercial printing, for meeting the demand of increasing the print image quality, it is likely that, rather than non-coated printing paper, coated printing paper is used as printing paper. However, paper is bought or sold in a unit of weight and therefore, for suppressing the cost for paper, the printing companies tend to demand lightweight coated printing paper having a reduced coating weight.

The lightweight coated printing paper hardly absorbs or fixes an ink only by the coating layer, and therefore is likely to suffer an ink strike-through phenomenon. Particularly, in an industrial inkjet printing press, the ink used has a low coloring material concentration and contains a large amount of a solvent for ink, and hence an ink strike-through phenomenon is likely to occur. Further, when the ink absorbing property of the lightweight coated printing paper is improved, the lightweight coated printing paper is more likely to suffer an ink strike-through phenomenon, and therefore it is necessary to optimize the lightweight coated printing paper while achieving a good balance between the ink absorbing property and the ink strike-through phenomenon. The "ink strike-through phenomenon" is a phenomenon in which an ink does not stop at the surface of paper on the printed side but reaches a deep portion of the paper, so that the printed image is visible from the other side. In commercial printing, double-side printing is frequently conducted, and the ink strike-through phenomenon reduces the value of printed materials as commercial products.

With respect to the inkjet recording paper described in Japanese Unexamined Patent Publication No. 2013-132854, a further improvement is needed in respect of the ink strike-through phenomenon. Further, with respect to the lightweight coated paper for offset printing described in Japanese Unexamined Patent Publication No. 2008-255551, the printability for an industrial inkjet printing press is not satisfactory.

An object of the present invention is to provide a lightweight coated printing paper for an industrial inkjet printing press, having the following properties:

1. that the lightweight coated printing paper has printability for an offset printing press (offset printability);
2. that the ink absorbing property for an industrial inkjet printing press using an aqueous dye based ink is excellent;
3. that the ink strike-through suppressing property for an industrial inkjet printing press using an aqueous dye based ink is excellent;
4. that the color density uniformity in the printed portion for an industrial inkjet printing press using an aqueous pigment based ink is excellent; and
5. that the ink strike-through suppressing property for an industrial inkjet printing press using an aqueous pigment based ink is excellent.

Means for Solving the Problems

In view of the above, the present inventor has conducted extensive and intensive studies. As a result, the object of the present invention is achieved by a lightweight coated printing paper for an industrial inkjet printing press, which has a base paper, and one or more coating layers being disposed on at least one surface of the base paper and containing a pigment and a binder, wherein the total coating weight of the coating layer(s) is 6 g/m$^2$ or less per one surface, at least one of the pigment in the coating layer(s) is ground calcium carbonate having an average particle diameter of 0.50 to 1.00 μm, wherein the amount of the ground calcium carbonate contained in the coating layer(s) is 50 parts by mass or more, relative to 100 parts by mass of the total of the pigment in the coating layer(s), the lightweight coated printing paper has an opacity of 92.0% or more as measured in accordance with JIS P 8149, a Stöckigt sizing degree of 1.0 to 8.0 seconds as measured in accordance with JIS P 8122, and a 10-second Cobb sizing degree of 30 to 80 g/m$^2$ as measured in accordance with JIS P 8140, wherein the ratio of the 10-second Cobb sizing degree to the Stöckigt sizing degree is 10.0 to 40.0.

It is preferred that the lightweight coated printing paper for an industrial inkjet printing press has a basis weight of 45 to 75 g/m$^2$.

It is preferred that the coating layer(s) contains at least one compound selected from the group consisting of a cationic resin and a water-soluble multivalent cation salt, wherein the total content of the compound in the coating layer(s), in terms of a dry solids content, is 0.10 to 1.00 g/m$^2$ per one surface.

Effects of the Invention

By the present invention, there can be provided a lightweight coated printing paper for an industrial inkjet printing press, which has printability for an offset printing press, and which has excellent ink absorbing property and excellent ink strike-through suppressing property for an industrial inkjet printing press using an aqueous dye based ink as well as excellent color density uniformity and excellent ink strike-through suppressing property for an industrial inkjet printing press using an aqueous pigment based ink.

MODE FOR CARRYING OUT THE INVENTION

Hereinbelow, the lightweight coated printing paper for an industrial inkjet printing press of the present invention (hereinafter, frequently referred to simply as "lightweight coated paper") will be described in detail. In the present specification, the term "inkjet printing" means printing using an industrial inkjet printing press. The expression "lightweight coated" means that the coating weight, for example, in terms of a dry solids content, is 6 g/m$^2$ or less per one surface, and that, with respect to the both sides coating, for each side, the coating weight is 6 g/m$^2$ or less per one surface. When the coating layer(s) on one side is different from that on another side, the coating weight indicates a value of the total of the coating weights of these layers. The term "coated paper" means paper having a coating layer and a substrate portion (base paper) distinct from one another when the cross-section of the paper is magnified and examined using an electron microscope.

Further, in the present specification, with respect to the amount of the component of a composition, when a plurality of materials corresponding to the components are present in the composition, the amount of the components in the composition means the total amount of the materials present in the composition unless otherwise specified.

With respect to the industrial inkjet printing press, there are those of a roll sheet type and those of a cut sheet type according to the type of paper feeding method. The types of inks to be mounted on the industrial inkjet printing press include an aqueous dye based ink having a dye as a coloring material and an aqueous pigment based ink having a pigment as a coloring material. With respect to the type of each of the paper feeding method and the ink for the industrial inkjet printing press in which the lightweight coated paper is used, any of the above types may be employed.

In the present specification, the printing speed of the industrial inkjet printing press is 60 m/min or more. Even when the printing speed is less than the above value, inkjet printing can be made. However, the remarkable effects of the present invention are recognized when the printing speed is 60 m/min or more. Further, from an industrial point of view, the productivity of printed materials is regarded as being important, and, for meeting demands for the productivity, it is desired that the printing speed is 60 m/min or more. When the paper to be printed is of a cut sheet type, the printing speed is calculated from the number of sheets printed per minute and the paper size printed.

When variable information and fixed information are present in the image to be printed, it is preferred that part of or all of the fixed information is printed using a conventional printer, such as a gravure printing press, an offset printing press, a letterpress printing press, a flexographic press, a thermal transfer printing press, or a toner printing press. Particularly, in view of the printed image quality and production cost, an offset printing press is preferred. The printing using a conventional printer may be performed either before or after printing using an industrial inkjet printing press.

Conventional printing presses include, for example, a gravure printing press, an offset printing press, a letterpress printing press, a flexographic press, a thermal transfer printing press, and a toner printing press. The gravure printing press is a printing press of an intaglio printing system in which an ink is transferred to a material to be printed through a roll-form plate cylinder having an image engraved therein. The offset printing press is a printing press of an indirect printing system in which an ink is once transferred to a blanket and further transferred to a material to be printed. The letterpress printing press is a printing press of a relief printing system in which a pressure is applied so as to press an ink applied onto a relief printing plate against a material to be printed to perform printing. The flexographic press is a printing press of a letterpress printing system using a flexible elastic resin plate. The thermal transfer printing press is a printing press using ink ribbons of respective colors, which is of a system in which coloring materials are transferred using heat from the respective ink ribbons to a material to be printed. The toner printing press is a printing press of an electrophotographic system in which a toner deposited on a charged drum is transferred to a material to be printed using static electricity.

The base paper is paper made from a paper stock containing at least one type of cellulose pulp selected from the group consisting of chemical pulp, such as LBKP (Leaf Bleached Kraft Pulp) and NBKP (Needle Bleached Kraft Pulp); mechanical pulp, such as GP (Groundwood Pulp), PGW (Pressure GroundWood pulp), RMP (Refiner Mechanical Pulp), TMP (ThermoMechanical Pulp), CTMP (ChemiThermoMechanical Pulp), CMP (ChemiMechanical Pulp), and CGP (ChemiGroundwood Pulp); and waste paper pulp, such as DIP (DeInked Pulp), and a filler, and further, if necessary, various additives, such as a sizing agent, a fixing agent, a retention aid, or a cationization agent, by a conventionally known acidic, neutral, or alkaline method.

As a filler, a conventionally known white pigment can be used. Examples of white pigments include white inorganic pigments, such as precipitated calcium carbonate, ground calcium carbonate, kaolin, talc, calcium sulfate, barium sulfate, titanium dioxide, zinc oxide, zinc sulfide, zinc carbonate, satin white, aluminum silicate, diatomaceous earth, alumina, lithopone, zeolite, magnesium carbonate, and magnesium hydroxide. Further examples include white organic pigments, such as a styrene plastic pigment, an acrylic plastic pigment, polyethylene, microcapsules, an urea resin, and a melamine resin. At least one member selected from these fillers can be used, or two or more types of the fillers may be used in combination.

The base paper preferably has an ash content of 15 to 30% by mass. The reason for this is that, when the ash content of the base paper is in the above-mentioned range, excellent relationship between the ink strike-through suppressing property for an industrial inkjet printing press and the physical strength of the base paper can be achieved. When the ash content of the base paper is 15% by mass or more, the ink strike-through suppressing property is likely to be further improved. When the ash content of the base paper is 30% by mass or less, the occurrence of a problem, such as picking or dusting, during printing using, for example, an offset printing press is likely to be further suppressed.

The ash content means a ratio (% by mass) of the mass of the non-combustible material remaining after subjecting the base paper to burning treatment at 500° C. for 1 hour to the absolute dry mass of the base paper before the burning treatment. The ash content can be controlled by a conventionally known method, for example, by appropriately changing the filler content of the base paper.

The base paper can appropriately contain, as an additional additive, for example, a pigment dispersant, a thickener, a fluidity-improving agent, a defoamer, an antifoamer, a releasing agent, a foaming agent, a penetrating agent, a coloring dye, a coloring pigment, an optical brightener, an ultraviolet light absorbing agent, an antioxidant, a preservative, a fungicide, an insolubilizer, or a paper strengthening agent in such an amount that the desired effects of the present invention are not sacrificed.

The lightweight coated paper contains, as at least one pigment in the coating layer(s), ground calcium carbonate having an average particle diameter of 0.50 to 1.00 μm, preferably 0.75 to 0.95 μm, wherein the amount of the ground calcium carbonate contained in the coating layer(s) is 50 parts by mass or more, preferably 75 parts by mass or more, relative to 100 parts by mass of the total of the pigments in the coating layer(s). When the pigment in the coating layer(s) does not meet the above requirements, the lightweight coated paper cannot satisfactorily obtain the ink absorbing property or ink strike-through suppressing property for an industrial inkjet printing press using an aqueous dye based ink, or color density uniformity or ink strike-through suppressing property for an industrial inkjet printing press using an aqueous pigment based ink.

In the present specification, with respect to the average particle diameter, in the case of individual particles, an average particle diameter of the individual particles is used, and, in the case where aggregate particles, such as secondary particles, are formed, an average particle diameter of the aggregate particles is used. An average particle diameter of the ground calcium carbonate can be determined in the state of lightweight coated paper. For example, using a scanning electron microscope having an elemental analysis function, such as an energy dispersive X-ray spectrometer, an electron photomicrograph is taken with respect to the surface of a lightweight coated paper, and the shape of a particle seen in the taken image is regarded as a cross-section of a circle which has an area approximating to that of the particle and a particle diameter of the circle is calculated. Particle diameters of 100 particles present in the image are individually calculated, and an arithmetic mean of the particle diameters is calculated, determining an average particle diameter.

The average particle diameter can also be determined by measurement using a laser diffraction-scattering method or a dynamic light scattering method. In such a case, the average particle diameter is an average particle diameter based on the volume-based particle size distribution measurement using a laser diffraction-scattering method or a dynamic light scattering method. With respect to the average particle diameter, in the case of individual particles, an average particle diameter of the individual particles is used, and, in the case where aggregate particles, such as secondary particles, are formed, an average particle diameter of the aggregate particles is used. An average particle diameter can be determined by calculation from the obtained particle size distribution. For example, an average particle diameter can be determined by measuring a particle size distribution using a laser diffraction-scattering type particle size distribution measurement apparatus Microtrac MT3300EXII, manufactured by Nikkiso Co., Ltd., and making a calculation.

The coating layer(s) can contain at least one conventionally known pigment in addition to the above-mentioned ground calcium carbonate. Examples of conventionally known pigments include inorganic pigments, such as various types of kaolin, clay, precipitated calcium carbonate, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, aluminum hydroxide, alumina, lithopone, zeolite, magnesium carbonate, and magnesium hydroxide, and organic pigments, such as a styrene plastic pigment, an acrylic plastic pigment, a styrene-acryl plastic pigment, polyethylene, microcapsules, an urea resin, and a melamine resin. These pigments may be used individually or in combination.

The ground calcium carbonate having the above-mentioned average particle diameter can be produced by, for example, the method described below. Firstly, natural limestone is dry ground, and the resultant powder is dispersed in water or an aqueous solution containing a dispersant to prepare a pre-dispersed slurry of ground calcium carbonate. The thus prepared pre-dispersed slurry is further wet ground using, for example, a bead mill. Natural limestone can also be directly wet ground. From the viewpoint of the productivity, it is preferred that natural limestone is dry ground in advance of wet ground. In the dry grinding, limestone is desirably ground so that the resultant limestone has a particle diameter of 40 mm or less, preferably an average particle diameter of about 2 μm to 2 mm. In the wet grinding, it is preferred that granulating of particle is performed in the course of the grinding so as to achieve a uniform particle diameter. The granulating of particle can be performed by means of a commercially available granulator.

Then, the surface of the ground limestone can be subjected to treatment with an organic dispersant. This treatment can be conducted by various methods, and preferred is a method in which the treatment is conducted by wet grinding the dry-ground limestone in the presence of an organic dispersant. Specifically, an aqueous medium is added to the limestone so that the limestone/aqueous medium (preferably water) mass ratio becomes in the range of from 30/70 to 85/15, preferably from 60/40 to 80/20, and an organic dispersant is added to the resultant mixture. Examples of organic dispersants include low-molecular or high-molecular water-soluble anionic surfactants having a carboxylate, a sulfate salt, a sulfonate, or a phosphate salt as a functional group, and polyethylene glycol-type or polyhydric alcohol-type nonionic surfactants. Of the organic dispersants, especially preferred is a polyacrylic acid type organic dispersant having polyacrylic acid which is a water-soluble anionic surfactant. These organic dispersants are commercially available from, for example, San Nopco Ltd., Toagosei Co., Ltd., and Kao Corporation, and one which is appropriately selected from them can be used. With respect to the amount of the organic dispersant used, there is no particular limitation, but the amount of the organic dispersant used is, relative to 100 parts by mass of the ground calcium carbonate, in terms of a solids content, preferably in the range of from 0.01 to 1 part by mass, more preferably in the range of from 0.02 to 0.5 part by mass. The obtained pre-dispersed slurry is wet ground by a conventionally known method. Alternatively, an aqueous medium having preliminarily dissolved therein an organic dispersant in an amount in the above-mentioned range is mixed with the limestone and the resultant mixture is wet ground by a conventionally known method. The wet grinding may be conducted in any of a batch-wise manner and a continuous manner, and can be performed by means of an apparatus, for example, a mill using a grinding medium, such as a sand mill, an attritor, or a ball mill. By performing the wet grinding as mentioned above, ground calcium carbonate having an average particle diameter of 0.50 to 1.00 μm can be obtained. However, the method for obtaining the ground calcium carbonate having the above-mentioned average particle diameter is not limited to the above-described method.

The coating layer(s) contains at least one binder. The binder is a conventionally known binder, and examples of the binders include polyacrylic acids, such as sodium polyacrylate and polyacrylamide; polyvinyl acetates; various copolymer latexes, such as a styrene-butadiene copolymer and ethylene-vinyl acetate; polyvinyl alcohol; modified polyvinyl alcohol; polyethylene oxide; formalin resins, such as urea and melamine; and water-soluble synthetic materials, such as polyethyleneimine, polyamide polyamine, and epichlorohydrin. Further, examples of the binders include starch obtained by refining natural plants, hydroxyethyl starch, oxidized starch, etherified starch, starch phosphate, enzyme-modified starch, cold water-soluble starch obtained by flash drying the above starch, natural polysaccharides, such as dextrin, mannan, chitosan, arabinogalactan, glycogen, inulin, pectin, hyaluronic acid, carboxymethyl cellulose, and hydroxyethyl cellulose, and oligomers thereof and modification products thereof. Further examples include natural proteins, such as casein, gelatin, soybean protein, and collagen, and modification products thereof, and synthetic polymers and oligomers, such as polylactic acid and peptides. These binders can be used individually or in combination. The binder can be subjected to cation modification before used. When the binder is incorporated in an excess amount relative to the pigment, the ink absorbing property may become poor, and therefore the amount of the binder contained is preferably in the range of from 3 to 30 parts by mass, more preferably in the range of from 5 to 20 parts by mass, relative to 100 parts by mass of the total solids content of the pigments in the coating layer(s).

The coating layer(s) preferably contains at least one compound (hereinafter, frequently referred to as "cationic compound") selected from the group consisting of a cationic resin and a water-soluble multivalent cation salt. When the coating layer(s) contains such a compound, the lightweight coated paper has offset printability and is further improved in the ink absorbing property and ink strike-through suppressing property for an industrial inkjet printing press using an aqueous dye based ink and the color density uniformity and ink strike-through suppressing property for an industrial inkjet printing press using an aqueous pigment based ink.

The cationic resin is a cationic polymer or cationic oligomer, and a conventionally known compound can be used. A preferred cationic resin is a polymer or oligomer to which a proton is easily coordinated, and which contains a primary, secondary, or tertiary amine or quaternary ammonium salt that is cationic when dissolved in water. Specific examples of the cationic resins include compounds, such as polyethyleneimine, polyvinylpyridine, polyamine sulfone, polydialkylaminoethyl methacrylate, polydialkylaminoethyl acrylate, polydialkylaminoethylmethacrylamide, polydialkylaminoethylacrylamide, polyepoxyamine, polyamideamine, a dicyandiamide-formalin condensation product, polyvinylamine, and polyallylamine, and hydrochlorides thereof; a copolymer of polydiallyldimethylammonium chloride and diallyldimethylammonium chloride and acrylamide or the like, a polydiallylmethylamine hydrochloride, and polycondensation products of an aliphatic monoamine or aliphatic polyamine and an epihalohydrin compound, such as a dimethylamine-epichlorohydrin polycondensation product and a diethylenetriamine-epichlorohydrin polycondensation product, but the cationic resin is not limited to these compounds. From the viewpoint of the easy commercial availability, preferred is a dimethylamine-epichlorohydrin polycondensation product. The number average molecular weight of the cationic resin is not particularly limited, but is preferably in the range of from 500 to 100,000.

The water-soluble multivalent cation salt is a water-soluble salt containing a multivalent cation of a metal. A preferred water-soluble multivalent cation salt is a salt which contains a multivalent cation of a metal, and which is capable of being dissolved in water at 20° C. in an amount of 1% by mass or more. Examples of multivalent cations of metals include bivalent cations of, for example, magnesium, calcium, strontium, barium, nickel, zinc, copper, iron, cobalt, tin, or manganese; trivalent cations of, for example, aluminum, iron, or chromium; tetravalent cations of, for example, titanium or zirconium; and complex ions thereof, and preferred is at least one member selected from the group consisting of these cations. An anion which forms a salt together with a multivalent cation of a metal may be an anion derived from any of an inorganic acid and an organic acid, and there is no particular limitation. Examples of inorganic acids include hydrochloric acid, nitric acid, phosphoric acid, sulfuric acid, boric acid, and hydrofluoric acid, and preferred is at least one member selected from the group consisting of these inorganic acids. Examples of organic acids include formic acid, acetic acid, lactic acid, citric acid, oxalic acid, succinic acid, and organic sulfonic acid, and preferred is at least one member selected from the group consisting of these organic acids. It should be noted that aluminum sulfate conventionally used as a fixing agent for a sizing agent is excluded from the water-soluble multivalent cation salt in the present specification.

The water-soluble multivalent cation salt is preferably at least one calcium salt selected from the group consisting of, for example, calcium chloride, calcium formate, calcium nitrate, and calcium acetate. The reason for this is that such a calcium salt does not cause the offset printability to be poor. From the viewpoint of the chemical cost, the water-soluble multivalent cation salt is preferably at least one of calcium chloride and calcium nitrate.

The total content of the compound(s) selected from the group consisting of a cationic resin and a water-soluble multivalent cation salt in the coating layer(s), in terms of a dry solids content, is preferably 0.10 to 1.00 g/m$^2$, more preferably 0.12 to 0.98 g/m$^2$, per one surface. When the total content of the compound(s) selected from the group consisting of a cationic resin and a water-soluble multivalent cation salt in the coating layer(s), in terms of a dry solids content, is in the above-mentioned range, the ink absorbing property or ink strike-through suppressing property for an industrial inkjet printing press using an aqueous dye based ink, or the color density uniformity or ink strike-through suppressing property for an industrial inkjet printing press using an aqueous pigment based ink is further improved.

In addition to the pigment, binder, and optionally contained compound(s) selected from the group consisting of a cationic resin and a water-soluble multivalent cation salt, if necessary, the coating layer(s) can contain conventionally known various auxiliaries generally used in the field of coated paper, such as a pigment dispersant, a thickener, a defoamer, an antifoamer, a foaming agent, a releasing agent, a penetrating agent, a wetting agent, a thermal gelling agent, a printability improver, a dye fixing agent, a lubricant, a dye, an optical brightener, or an insolubilizer.

The coating layer(s) can be obtained by applying a coating layer-coating composition onto a base paper and drying the applied composition. As a method for applying the coating layer-coating composition onto a base paper, there can be mentioned a method using, for example, an air-knife coater, various types of blade coaters, such as a rod blade coater, a roll coater, a bar coater, a curtain coater, a short dwell coater, or a film transfer coater, but there is no particular limitation. Preferred are various types of blade coaters and a film transfer coater, which are suitable for high-speed productivity, and especially preferred is a film transfer coater. As a drying method, there can be used a drying apparatus generally used, and there is no particular limitation. Examples of the drying apparatuses include various types of drying apparatuses, for example, hot-air dryers, such as a linear tunnel dryer, an arch dryer, an air loop dryer, and a sine curve air-float dryer, an infrared heating dryer, and a dryer using microwaves.

The Stöckigt sizing degree of the lightweight coated paper is a value measured in accordance with JIS P 8122. The Stöckigt sizing degree of the lightweight coated paper is 1.0 to 8.0 seconds, preferably 1.5 to 6.0 seconds. When the Stöckigt sizing degree of the lightweight coated paper is less than 1.0 second, the ink strike-through suppressing property for an industrial inkjet printing press using an aqueous dye based ink and the offset printability are poor. When the Stöckigt sizing degree of the lightweight coated paper is more than 8.0 seconds, the ink absorbing property for an industrial inkjet printing press using an aqueous dye based ink is poor.

The Cobb sizing degree of the lightweight coated paper is a value measured in accordance with JIS P 8140. The 10-second Cobb sizing degree of the lightweight coated paper, wherein the contact time between the lightweight coated paper and a solvent for measurement is 10 seconds, is 30 to 80 g/m$^2$, preferably 45 to 76 g/m$^2$. When the 10-second Cobb sizing degree of the lightweight coated paper is less than 30 g/m$^2$, the color density uniformity for an industrial inkjet printing press using an aqueous pigment based ink is poor. When the 10-second Cobb sizing degree of the lightweight coated paper is more than 80 g/m$^2$, the ink strike-through suppressing property for an industrial inkjet printing press and the offset printability are poor.

Representative indices generally indicating the sizing of printing paper include a Stöckigt sizing degree and a Cobb sizing degree which are measured based on different principles. With respect to the printing paper used in conventional printing presses, various values of the Stöckigt sizing degree and Cobb sizing degree are present. However, merely by individually studying these indices, the printability for inkjet printing cannot be satisfactorily optimized. It has been found that, with respect to the lightweight coated paper, the ratio of the 10-second Cobb sizing degree to the Stöckigt sizing degree, that is, 10-second Cobb sizing degree/Stöckigt sizing degree ratio is determined and, when the ratio falls in a specific range, the printability for inkjet printing is well optimized. As a result, the lightweight coated paper has offset printability and further can obtain an ink absorbing property for an industrial inkjet printing press using an aqueous dye based ink, color density uniformity for an industrial inkjet printing press using an aqueous pigment based ink, and an ink strike-through suppressing property for an industrial inkjet printing press. The 10-second Cobb sizing degree/Stöckigt sizing degree ratio of the lightweight coated paper is 10.0 to 40.0, preferably 14.3 to 38.0. When the 10-second Cobb sizing degree/Stöckigt sizing degree ratio of the lightweight coated paper is less than 10.0, the ink absorbing property for an industrial inkjet printing press using an aqueous dye based ink and the color density uniformity for an industrial inkjet printing press using an aqueous pigment based ink are poor. When the 10-second Cobb sizing degree/Stöckigt sizing degree ratio of the lightweight coated paper is more than 40.0, the ink strike-through suppressing property for an industrial inkjet printing press is poor.

The sizing degree of the lightweight coated paper can be controlled by appropriately changing the type and amount of an internal sizing agent contained in the base paper, the type and amount of a filler, the type and amount of an additive, such as a paper strengthening additive, the types and amounts of the pigment and binder contained in the coating layer(s), and the type and amount of the cationic resin or water-soluble multivalent cation salt contained in the coating layer(s). With respect to the internal sizing agent contained in the base paper, for example, in the case of acidic paper, the sizing agent is a rosin sizing agent, and, in the case of alkaline paper, the sizing agent is an alkenylsuccinic anhydride, an alkylketene dimer, a neutral rosin sizing agent, or a cationic styrene-acryl sizing agent.

The base paper or lightweight coated paper can be subjected to calendering treatment before used.

When an excessive calendering treatment is conducted after coating, the voids in the lightweight coated paper collapse, causing the printability of the lightweight coated paper for inkjet printing to become poor. Therefore, an appropriate calendering treatment is preferred.

The lightweight coated paper has an opacity of 92.0% or more, preferably 93% or more, as measured in accordance with JIS P 8149. The reason for this is that, when the opacity is less than 92.0%, the lightweight coated paper is poor in ink strike-through suppressing property.

The lightweight coated paper of the present invention preferably has a basis weight in the range of from 45 to 75 g/m$^2$, more preferably in the range of from 46 to 73 g/m$^2$. The reason for this is that, when the lightweight coated paper has a basis weight in the above range, the ink strike-through suppressing property aimed at by the present invention is more remarkably exhibited. Further, the reason is that the basis weight of the lightweight coated paper in the above-mentioned range is advantageous from the viewpoint of uses of the lightweight coated paper in the field of commercial printing, such as a textbook, a magazine, a bill, a detailed statement for dealings, an advertising insert, a direct mail, and a combination thereof, which is a so-called transpromotion.

The opacity and basis weight are conventionally known physical property values in the field of paper making, and can be controlled by a conventionally known method.

The lightweight coated paper of the present invention is used in an industrial inkjet printing press. A preferred industrial inkjet printing press is an industrial inkjet printing press of a rotary press method having a printing speed of more than 120 m/min. The lightweight coated paper of the present invention can be used not only in an industrial inkjet printing press but also in, for example, a commercially available inkjet printer for SOHO.

EXAMPLES

Hereinbelow, the present invention will be described in more detail with reference to the following Examples, which should not be construed as limiting the scope of the present invention. In the following Examples, the "part(s) by mass" and "% by mass" individually indicate a value of dry solids content or substantial component unless otherwise specified. Further, the coating weight indicates a value in terms of a dry solids content.

<Measurement of an Average Particle Diameter>

With respect to the surface of the lightweight coated paper obtained as mentioned below, a photograph was taken by means of a scanning electron microscope (JSM-6490LA, manufactured by JEOL Ltd.), and a particle seen in the taken image was regarded as a cross-section of a circle which has an area approximating to that of the particle and a particle diameter of the circle was calculated. Particle diameters of 100 particles present in the image were individually calculated, and an arithmetic mean of the particle diameters was calculated to determine an average particle diameter. The determined average particle diameter is shown in Table 1.

<Preparation of Ground Calcium Carbonate>

Ground calcium carbonate was prepared as follows. Natural limestone was roughly ground by means of a jaw crusher, a hammer crusher, and a roller mill until the average particle diameter of the resultant ground limestone became about 30 μm, and, if necessary, the ground limestone was subjected to granulating of particle, and water and a commercially available polyacrylic acid dispersant were added to the resultant limestone, followed by stirring, to form a pre-dispersed slurry having a solids content of about 75% by mass. The pre-dispersed slurry was treated using a wet-grinder, manufactured by Ashizawa Finetech Ltd. (horizontal type; size of the cylindrical grinding chamber: diameter: about 0.5 m; length: about 1.3 m), and then, if necessary, the resultant slurry was subjected to granulating of particle. As beads, those being made of zirconia and having a diameter of about 0.5 mm were used. The packing ratio of the beads was changed in the range of from 70 to 80% by volume. The flow rate was about 15 liters/minute, and the pass number was changed. Ground calcium carbonates having various average particle diameters were prepared according to the above-mentioned procedure.

The above-prepared ground calcium carbonate was used in producing lightweight coated paper in each of the Examples and Comparative Examples.

Lightweight coated paper in each of the Examples and Comparative Examples was prepared in accordance with the following procedure.

<Preparation of a Paper Stock>

A paper stock having the formulation shown below was prepared.

| | |
|---|---|
| LBKP (freeness: 400 mlcsf) | 100 Parts by mass |
| Sizing agent (Alkylketene dimer) | |

The respective amounts are shown in Table 1.

Filler (Precipitated Calcium Carbonate)

The respective amounts are shown in Table 1.

| | |
|---|---|
| Amphoteric starch | 0.08 Part by mass |
| Aluminum sulfate | 0.08 Part by mass |

<Preparation of a Coating Layer-Coating Composition>

A coating layer-coating composition having the formulation shown below was prepared.

Ground Calcium Carbonate

The respective average particle diameters and amounts are shown in Table 1.

Other Pigments

The respective types and amounts are shown in Table 1.

| | |
|---|---|
| Polyvinyl alcohol | 5 Parts by mass |
| Starch phosphate | 10 Parts by mass |

Compound selected from the group consisting of a cationic resin and a water-soluble cation salt (Cationic compound)

The respective types and amounts are shown in Table 1.

The ingredients having the formulation shown above were incorporated, and mixed with and dispersed in water so as to control the concentration to be 40% by mass.

<Preparation of Lightweight Coated Paper>

A paper stock prepared from pulp and internal chemicals in the above-mentioned formulation was subjected to paper making using a fourdrinier paper machine to obtain a base paper. Subsequently, using a film transfer coater fitted to an on-machine coater, the above-prepared coating layer-coating composition was applied to both surfaces of the obtained base paper so that the coating weight per surface became 5 g/m$^2$, followed by drying. After drying, the resultant base paper was subjected to calendering treatment to prepare a lightweight coated paper. The calendering was performed using an apparatus comprising an elastic roll and a metal roll at a linear pressure of 60 kN/m with a nip linear pressure in such a range that an appropriate thickness profile in the width direction was able to be obtained. The temperature of the metal roll was 40° C.

With respect to the lightweight coated paper, the basis weight, the amount of the cationic compound contained per surface, the opacity, the Stöckigt sizing degree, the 10-second Cobb sizing degree, and the ratio of the 10-second Cobb sizing degree to the Stöckigt sizing degree are shown in Table 1. The opacity of the lightweight coated paper was measured in accordance with the opacity measurement method described in JIS P 8149. The Stöckigt sizing degree of the lightweight coated paper was measured in accordance with the Stöckigt sizing degree measurement method described in JIS P 8122. The 10-second Cobb sizing degree of the lightweight coated paper was measured in accordance with the Cobb water absorptiveness measurement method described in JIS P 8140. The contact time between a solvent for measurement and the lightweight coated paper was 10 seconds, and pure water was used as the solvent for measurement.

TABLE 1

| | Base paper | | Coating layer | | | | | | Lightweight coated printing paper | | | | |
|---|---|---|---|---|---|---|---|---|---|---|---|---|---|
| | Sizing agent (Parts by mass) | Filler (Parts by mass) | Pigment: Ground calcium carbonate: Average partcle diameter (μm) | Pigment: Ground calcium carbonate: (Parts by mass) | Pigment: Other pigments: Type | Pigment: Other pigments: (Parts by mass) | Cationic compound: Type | Cationic compound: Content (per surface) (g/m$^2$) | Basis weight (g/m$^2$) | Opacity (%) | Stöckigt sizing degree (Second) | 10-Second Cobb sizing degree (g/m$^2$) | 10-Second Cobb sizing degree/Stöckigt sizing degree ratio |
| Example 1 | 0.10 | 18 | 0.90 | 100 | — | — | a | 0.60 | 63 | 93.5 | 3.0 | 60 | 20.0 |
| Example 2 | 0.07 | 18 | 0.90 | 100 | — | — | a | 0.60 | 63 | 93.5 | 2.0 | 76 | 38.0 |
| Example 3 | 0.13 | 18 | 0.90 | 100 | — | — | a | 0.60 | 63 | 93.5 | 5.0 | 50 | 10.0 |
| Example 4 | 0.10 | 18 | 0.50 | 100 | — | — | a | 0.60 | 63 | 93.3 | 2.5 | 65 | 26.0 |
| Example 5 | 0.10 | 18 | 1.00 | 100 | — | — | a | 0.60 | 63 | 93.7 | 4.0 | 57 | 14.3 |
| Example 6 | 0.10 | 18 | 0.90 | 100 | — | — | a | 0.60 | 46 | 92.3 | 1.5 | 45 | 30.0 |
| Example 7 | 0.10 | 18 | 0.90 | 100 | — | — | a | 0.60 | 73 | 94.7 | 4.0 | 70 | 17.5 |
| Example 8 | 0.10 | 18 | 0.90 | 75 | A | 25 | a | 0.60 | 63 | 93.5 | 3.0 | 63 | 21.0 |
| Example 9 | 0.10 | 18 | 0.90 | 50 | A | 50 | a | 0.60 | 63 | 93.6 | 4.0 | 65 | 16.3 |
| Example 10 | 0.10 | 18 | 0.90 | 50 | B | 50 | a | 0.60 | 63 | 94.2 | 4.5 | 50 | 11.1 |
| Example 11 | 0.10 | 18 | 0.90 | 100 | — | — | b | 0.60 | 63 | 93.4 | 3.0 | 66 | 22.0 |
| Example 12 | 0.10 | 18 | 0.90 | 100 | — | — | c | 0.60 | 63 | 93.4 | 3.0 | 66 | 22.0 |
| Example 13 | 0.10 | 18 | 0.90 | 100 | — | — | a<br>c | 0.30<br>0.30 | 63 | 93.4 | 3.0 | 63 | 21.0 |
| Example 14 | 0.10 | 18 | 0.90 | 100 | — | — | d | 0.60 | 63 | 93.3 | 3.0 | 52 | 17.3 |
| Example 15 | 0.10 | 18 | 0.90 | 100 | — | — | e | 0.60 | 63 | 93.4 | 3.0 | 64 | 21.3 |
| Example 16 | 0.10 | 18 | 0.90 | 100 | — | — | a | 0.08 | 63 | 93.4 | 4.0 | 48 | 12.0 |
| Example 17 | 0.10 | 18 | 0.90 | 100 | — | — | a | 0.12 | 63 | 93.4 | 4.0 | 50 | 12.5 |
| Example 18 | 0.10 | 18 | 0.90 | 100 | — | — | a | 0.98 | 63 | 93.4 | 3.0 | 68 | 22.7 |

TABLE 1-continued

| | Base paper | | Coating layer | | | | | | Lightweight | | | | 10-Second Cobb |
|---|---|---|---|---|---|---|---|---|---|---|---|---|---|
| | Sizing | | Pigment | | | | Cationic compound | | coated | | | 10- | sizing |
| | agent (Parts | Filler (Parts | Ground calcium carbonate | | Other pigments | | | Content (per | printing paper Basis | | Stöckigt sizing | Second Cobb sizing | degree/ Stöckigt sizing |
| | by mass) | by mass) | Average partcle diameter (μm) | (Parts by mass) | Type | (Parts by mass) | Type | surface) ($g/m^2$) | weight ($g/m^2$) | Opacity (%) | degree (Second) | degree ($g/m^2$) | degree ratio |
| Example 19 | 0.10 | 18 | 0.90 | 100 | — | — | a | 1.10 | 63 | 93.4 | 3.0 | 70 | 23.3 |
| Example 20 | 0.10 | 18 | 0.90 | 100 | — | — | f | 0.60 | 63 | 93.4 | 5.0 | 55 | 11.0 |
| Example 21 | 0.10 | 13 | 0.90 | 100 | — | — | a | 0.05 | 63 | 92.4 | 3.0 | 31 | 10.3 |
| Example 22 | 0.10 | 15 | 0.90 | 100 | — | — | a | 0.07 | 63 | 92.8 | 3.5 | 39 | 11.1 |
| Example 23 | 0.15 | 18 | 0.90 | 100 | — | — | a | 1.20 | 63 | 93.5 | 6.0 | 68 | 11.3 |
| Example 24 | 0.16 | 18 | 0.90 | 100 | — | — | a | 1.40 | 63 | 93.5 | 8.0 | 80 | 10.0 |
| Comparative Example 1 | 0.04 | 18 | 0.90 | 100 | — | — | a | 0.60 | 63 | 93.4 | 0.9 | 84 | 93.3 |
| Comparative Example 2 | 0.20 | 18 | 0.90 | 100 | — | — | a | 0.60 | 63 | 93.4 | 10.0 | 29 | 2.9 |
| Comparative Example 3 | 0.18 | 18 | 0.90 | 100 | — | — | a | 1.00 | 63 | 93.4 | 8.2 | 35 | 4.3 |
| Comparative Example 4 | 0.14 | 18 | 0.90 | 100 | — | — | a | 0.60 | 63 | 93.4 | 5.2 | 48 | 9.2 |
| Comparative Example 5 | 0.06 | 18 | 0.90 | 100 | — | — | a | 0.60 | 63 | 93.4 | 1.8 | 78 | 43.3 |
| Comparative Example 6 | 0.10 | 6 | 0.90 | 100 | — | — | a | 0.60 | 63 | 91.5 | 4.0 | 54 | 13.5 |
| Comparative Example 7 | 0.10 | 18 | 0.90 | 40 | B | 60 | a | 0.60 | 63 | 94.3 | 4.7 | 47 | 10.0 |
| Comparative Example 8 | 0.10 | 18 | 0.48 | 100 | — | — | a | 0.60 | 63 | 93.3 | 2.4 | 66 | 27.5 |
| Comparative Example 9 | 0.10 | 18 | 1.10 | 100 | — | — | a | 0.60 | 63 | 93.7 | 4.1 | 56 | 13.7 |

The other pigments indicated by abbreviations in Table 1 are as follows.

A: Precipitated calcium carbonate (TP123, manufactured by Okutama Kogyo Co., Ltd.; average particle diameter: 0.63 μm)

B: Kaolin (HG-90, manufactured by J. M. Huber Corporation; average particle diameter: 0.19 μm)

The compounds selected from a cationic resin and a water-soluble cation salt (cationic compounds) indicated by abbreviations in Table 1 are as follows.

a: Dimethylamine-epichlorohydrin polycondensation product (JETFIX 5052, manufactured by Satoda Chemical Industrial Co., Ltd.)

b: Calcium chloride c: Calcium nitrate d: Polyethyleneimine (EPOMIN, manufactured by Nippon Shokubai Co., Ltd.)

e: Magnesium sulfate f: Sodium chloride

With respect to the lightweight coated paper obtained in each of the Examples and Comparative Examples, evaluations of the individual items were made in accordance with the methods described below.

<Evaluation of the Offset Printability>

Using an offset form rotary press, manufactured by Miyakoshi Printing Machinery, Co., Ltd., 6,000 m printing was performed under the following conditions: printing speed: 150 m/min; ink used: T&K TOKA UV Best Cure Black and Bronze Red; and UV irradiation dose: 8 kW×2, and, after printing, with respect to the occurrence of blanket piling and the state of the printed sample, visual evaluation was made. In the present invention, ratings 3 to 5 for the evaluation indicate that the lightweight coated paper has offset printability.

5: Very excellent.

4: Excellent.

3: No problem from the practical viewpoint.

2: Poor.

1: Very poor.

<Evaluation of the Ink Absorbing Property for an Industrial Inkjet Printing Press (Aqueous Dye Based Ink)>

Using an industrial inkjet printing press MJP20C, manufactured by Miyakoshi Printing Machinery, Co., Ltd., and using an aqueous dye based ink, an image for evaluation was printed 6,000 m at 150 m/min. The printing was conducted by a method in which solid patterns with seven colors in total, specifically, single-color solid patterns of black, cyan, magenta, and yellow and mixed-color solid patterns (red, green, and blue) obtained using the inks of two colors from the above three colors other than black were recorded so that the solid patterns in a 2 cm×2 cm square were arranged in a horizontal line without a gap. Visual evaluation was made from the viewpoint of blurring of the solid printed image portion of each color and the boundary printed image portion. In the present invention, ratings 3 to 5 for the evaluation indicate that the lightweight coated paper has excellent ink absorbing property for an industrial inkjet printing press using an aqueous dye based ink.

5: The boundary portions between colors do not blur.

4: The boundary portions between colors do substantially not blur.

3: The boundary portions between colors blur, but the boundary portions can be clearly recognized.

2: The boundary portions between colors are not clear, and the adjacent colors slightly move into one another across the boundary portion.

1: The boundary portions between the individual colors are unclear and considerably blur and move into the adjacent colors.

<Evaluation of the Color Density Uniformity for an Industrial Inkjet Printing Press (Aqueous Pigment Based Ink)>

Using an industrial inkjet printing press Prosper 5000XL Press, manufactured by Eastman Kodak Company, and using an aqueous pigment based ink, an image for evaluation was printed 6,000 m at 75 m/min. The printing was conducted by a method in which solid patterns with seven colors in total, specifically, single-color solid patterns of black, cyan, magenta, and yellow and mixed-color solid patterns (red, green, and blue) obtained using the inks of two colors from the above three colors other than black were recorded so that the solid patterns in a 3 cm×3 cm square were arranged in a horizontal line without a gap. With respect to the color density uniformity of the solid printed portion of each color, visual evaluation was made. In the present invention, ratings 3 to 5 for the evaluation indicate that the lightweight coated paper has excellent color density uniformity for an industrial inkjet printing press using an aqueous pigment based ink.

5: The color density is uniform.

4: The density is very slightly non-uniform depending on the color.

3: The color density is slightly non-uniform.

2: The color density is partially non-uniform.

1: The color density is non-uniform all over the printed portion.

<Evaluation of the Ink Strike-Through Suppressing Property for an Industrial Inkjet Printing Press>

With respect to an aqueous dye based ink, using an industrial inkjet printing press MJP20C, manufactured by Miyakoshi Printing Machinery, Co., Ltd., an image for evaluation was printed 6,000 m at 150 m/min. With respect to an aqueous pigment based ink, using an industrial inkjet printing press Prosper 5000XL Press, manufactured by Eastman Kodak Company, an image for evaluation was printed 6,000 m at 75 m/min. The printing was conducted by a method in which a black solid printed pattern was recorded in a 10 cm×10 cm square. A brightness was measured from the other side of the black solid printed portion using the brightness measurement method described in JIS P 8148, and ink strike-through of the lightweight coated paper was evaluated using the "Brightness (%) of the unprinted white portion"−"Brightness (%) of the black solid printed portion". The measurement of a brightness was conducted using PF-10, manufactured by Nippon Denshoku Industries Co., Ltd., with respect to one sheet of a sample placed on a standard plate under conditions for cutting out a UV light. In the present invention, ratings 3 to 5 for the evaluation indicate that the lightweight coated paper has excellent ink strike-through suppressing property for an industrial inkjet printing press.

5: Less than 10%.

4: 10 to less than 13%.

3: 13 to less than 16%.

2: 16 to less than 19%.

1: 19% or more.

The results of the evaluation in the Examples and Comparative Examples are shown in Table 2.

TABLE 2

| | | Industrial inkjet printing press | | | |
|---|---|---|---|---|---|
| | | Dye based ink | | Pigment based ink | |
| | Offset printability | Ink absorbing property | Ink strike-through | Color density uniformity | Ink strike-through |
| Example 1 | 4 | 5 | 4 | 4 | 4 |
| Example 2 | 4 | 5 | 4 | 4 | 4 |
| Example 3 | 5 | 4 | 5 | 4 | 4 |
| Example 4 | 4 | 5 | 4 | 5 | 4 |
| Example 5 | 5 | 4 | 4 | 4 | 5 |
| Example 6 | 4 | 5 | 4 | 4 | 4 |
| Example 7 | 4 | 5 | 5 | 5 | 4 |
| Example 8 | 4 | 4 | 4 | 4 | 4 |
| Example 9 | 3 | 4 | 4 | 4 | 4 |
| Example 10 | 3 | 3 | 5 | 3 | 5 |
| Example 11 | 5 | 5 | 5 | 5 | 5 |
| Example 12 | 5 | 5 | 5 | 5 | 5 |
| Example 13 | 5 | 5 | 5 | 5 | 5 |
| Example 14 | 4 | 4 | 4 | 4 | 4 |
| Example 15 | 4 | 4 | 4 | 4 | 4 |
| Example 16 | 5 | 3 | 3 | 3 | 3 |
| Example 17 | 5 | 4 | 4 | 4 | 4 |
| Example 18 | 4 | 4 | 5 | 4 | 5 |
| Example 19 | 4 | 3 | 5 | 3 | 5 |
| Example 20 | 3 | 3 | 3 | 3 | 3 |
| Example 21 | 5 | 3 | 3 | 3 | 3 |
| Example 22 | 5 | 3 | 3 | 3 | 3 |
| Example 23 | 4 | 3 | 4 | 3 | 4 |
| Example 24 | 4 | 3 | 4 | 3 | 4 |
| Comparative Example 1 | 2 | 4 | 1 | 4 | 1 |
| Comparative Example 2 | 5 | 1 | 3 | 1 | 3 |
| Comparative Example 3 | 4 | 2 | 3 | 2 | 3 |
| Comparative Example 4 | 4 | 2 | 3 | 2 | 3 |
| Comparative Example 5 | 3 | 3 | 2 | 3 | 2 |
| Comparative Example 6 | 4 | 3 | 2 | 3 | 2 |
| Comparative Example 7 | 2 | 2 | 5 | 2 | 5 |
| Comparative Example 8 | 4 | 5 | 2 | 4 | 2 |
| Comparative Example 9 | 5 | 2 | 4 | 2 | 5 |

From Table 2, it is apparent that the lightweight coated paper in each of the Examples corresponding to the present invention has offset printability, and further has excellent ink absorbing property and excellent ink strike-through suppressing property for an industrial inkjet printing press using an aqueous dye based ink as well as excellent color density uniformity and excellent ink strike-through suppressing property for an industrial inkjet printing press using an aqueous pigment based ink.

On the other hand, as apparent from Table 2, in each of the Comparative Examples which do not satisfy the requirements of the present invention, the effects of the present invention cannot be obtained.

The whole of the disclosure of Japanese Patent Application No. 2014-024367 (filing date: Feb. 12, 2014) is incorporated by reference in its entirety.

All the reference documents, patent applications, and technical standards described in the present specification are incorporated by reference herein to the same extent as that in the case where each of the reference documents, patent applications, and technical standards is specifically and individually shown to be incorporated by reference herein.

The invention claimed is:

1. A lightweight coated printing paper for an industrial inkjet printing press, having a base paper, and one or more coating layers being disposed on at least one surface of the base paper and containing a pigment and a binder, wherein the total coating weight of the coating layer(s) is 6 $g/m^2$ or less per one surface, at least one of the pigment in the coating layer(s) is ground calcium carbonate having an average particle diameter of 0.50 to 1.00 μm, wherein the amount of the ground calcium carbonate contained in the coating layer(s) is 50 parts by mass or more, relative to 100 parts by mass of the total of the pigment in the coating layer(s), the coating layer(s) contains at least one component selected from the group consisting of a cationic resin and a water-soluble multivalent cation salt, wherein the total content of the compound in the coating layer(s), in terms of a dry solids content, is 0.10 to 1.00 $g/m^2$ per one surface, the lightweight coated printing paper has an opacity of 92.0% or more as measured in accordance with JIS P 8149, a Stöckigt sizing degree of 1.0 to 8.0 seconds as measured in accordance with JIS P 8122, and a 10-second Cobb sizing degree of 30 to 80 $g/m^2$ as measured in accordance with JIS P 8140, wherein the ratio of the 10-second Cobb sizing degree to the Stöckigt sizing degree is 10.0 to 40.0.

2. The lightweight coated printing paper for an industrial inkjet printing press according to claim 1, which has a basis weight of 45 to 75 $g/m^2$.

* * * * *